US006769209B2

(12) United States Patent
Mendoza-Orozco

(10) Patent No.: US 6,769,209 B2
(45) Date of Patent: Aug. 3, 2004

(54) REMOVABLE INTERIOR BARREL ADAPTABLE IN AN INTERIOR OF AN ORIGINAL BARREL FOR AMMUNITION OR PELLETS FOR SPORT RIFLES

(76) Inventor: Hector Mendoza-Orozco, Prol.Constitucion,No.57 Colonia Santiago Tepalcatlalpan, Xochimilco, DF. 16210 (MX)

( * ) Notice: Subject to any disclaimer, the term of this patent is extended or adjusted under 35 U.S.C. 154(b) by 0 days.

(21) Appl. No.: 10/278,044

(22) Filed: Oct. 23, 2002

(65) Prior Publication Data

US 2004/0060221 A1 Apr. 1, 2004

(30) Foreign Application Priority Data

Oct. 3, 2002 (MX) ..... 200209263

(51) Int. Cl.[7] ..... F41A 21/00
(52) U.S. Cl. ..... 42/77; 42/78
(58) Field of Search ..... 42/77, 76.01, 1.06; 89/29, 14.3

(56) References Cited

U.S. PATENT DOCUMENTS 213,616 A * 3/1879 Bowles ..... 42/77
2,976,638 A * 3/1961 Owens ..... 42/77
4,455,777 A * 6/1984 Callies ..... 42/59
4,735,009 A * 4/1988 Jett, Jr. ..... 42/77
4,833,808 A * 5/1989 Strahan ..... 42/1.06
5,448,848 A * 9/1995 Moller ..... 42/77
5,501,135 A * 3/1996 Beretta ..... 89/196
5,706,599 A * 1/1998 Knight ..... 42/75.02
6,357,331 B1 * 3/2002 Dionne ..... 89/29
6,494,195 B2 * 12/2002 Perry et al. ..... 124/84
6,513,274 B1 * 2/2003 Vastag ..... 42/77

* cited by examiner

*Primary Examiner*—Michael J. Carone
*Assistant Examiner*—Denise Buckley
(74) *Attorney, Agent, or Firm*—Harrison & Egbert

(57) ABSTRACT

A removable inner barrel apparatus has a rifle with barrel extending therefrom, an inner barrel having an end through which ammunition can exit, a pressure nut removably fastening the barrel of the rifle to the inner barrel, and a compression spring positioned within the pressure nut. The inner barrel has a grooved hollow interior and a bushing affixed adjacent to an opposite end thereof. The compression spring urges against a surface of the bushing so as to urge the bushing against the end of the inner barrel.

1 Claim, 2 Drawing Sheets

REMOVABLE INTERIOR BARREL ADAPTABLE IN AN INTERIOR OF AN ORIGINAL BARREL FOR AMMUNITION OR PELLETS FOR SPORT RIFLES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention refers to a novel inner barrel for sport rifles, which has the particularity to be installed or removed in a simple way and allows the use of ammunition or pellets of different calibers.

In this way, the sport rifle becomes a versatile device that uses indifferently either ammunition or pellets of different calibers without the necessity of removing the barrel. On the other hand, this inner barrel can be adapted in sport rifles carrying out, previously, a simple repair consisted in making a cord on the mouth of the barrel and increasing the correlative diameter to the proposed inner barrel, in order to become a versatile rifle.

This novel invention has to be installed in the interior of the original barrel of the sport rifle, introducing enough of the proposed barrel by the end of the original barrel, where the sight point is normally located. The adjustment and bond of the proposed barrel is made by means of an external nut, which is tightened manually, with no need of any tool, in order to be able to shoot the weapon immediately.

BACKGROUND OF THE INVENTION

The development of the versatility of barrels change for conventional rifles and non-sport ones, has been discussed and made accessible in many ways such as the special barrels interchange which are made in a special way, which exceed from the discussed considerations in this work.

The proposed invention has the characteristic of using the same original barrel of the sport weapon and introducing inside this, a removable inner barrel according to the desired caliber, so the sport rifle is accompanied of various removable inner barrels depending on the caliber to be used.

Besides, the proposed invention can adapt to already existing sport rifles by means of a very simple repair.

Dealing with sport air rifles, operated by springs or by gas, it has not been considered, and consequently according to the author's best knowledge of the proposed invention, there are no registered or published records.

BRIEF SUMMARY OF THE INVENTION

The present invention is used as a sport and diversion article, where different calibers of ammunition or pellets can be used with only inner barrels substitution.

This has a fundamental economic advantage, because one can shoot either ammunition or pellets with a high-speed exit and a minor exit impact force or vice versa, without the need to acquire sport rifles of many calibers. Accordingly, the present invention has its reach inside the sport air rifles universe operated with springs or by means of gas either for ammunition or for pellets.

It is one aim of the present invention, to use indifferently different types of calibers for ammunition or pellets for sport rifles.

It is another aim of this invention, to count with different types of removable inner barrels to be placed inside the barrel of a sport rifle in a simple way and without using any tools.

It is another aim of the present invention to eliminate the cylindrical formed packing in the original barrel of the sport rifle, precisely in the place where the ammunition of the pellets are placed, because the proposed invention includes a shove mechanism in the inner barrel against the plate of the caisson of the weapon mechanism, whose longitudinal movement avoids the leak of pressure.

The characteristic details of this adaptable inner barrel in the interior of the original barrel of ammunition or pellets sport rifles, are clearly shown in the next description and in the drawings attached, as an illustration of such, and the same reference signs used to indicate the same parts in the shown figures.

DETAILED DESCRIPTION OF THE INVENTION

Figure 1:
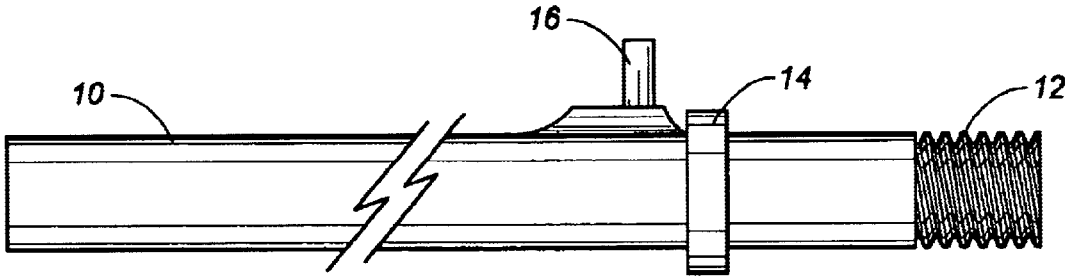
FIG. 1 is a side view of the original barrel for a sport rifle.
Figure 2:
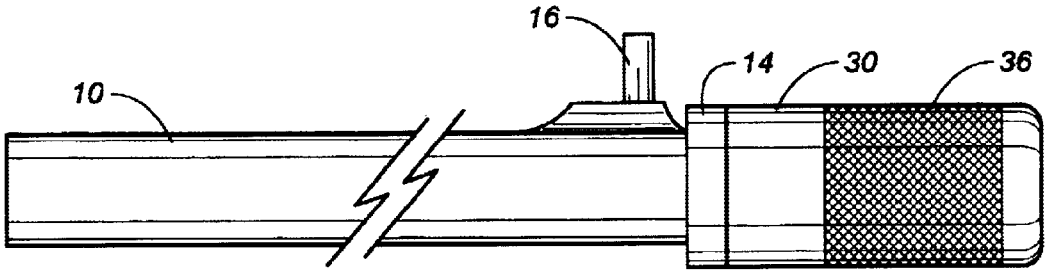
FIG. 2 is a side view of the original barrel of a sport rifle with part of the proposed invention.
Figure 3:
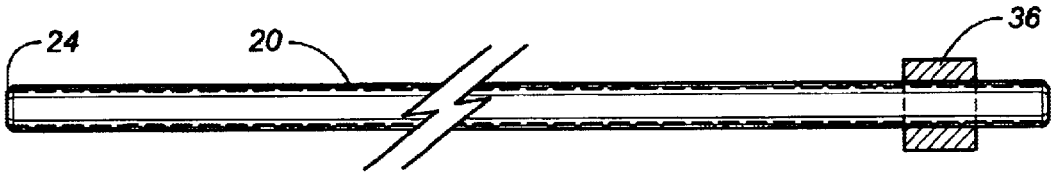
FIG. 3 is a sectional view of the removable inner barrel.
Figure 4:
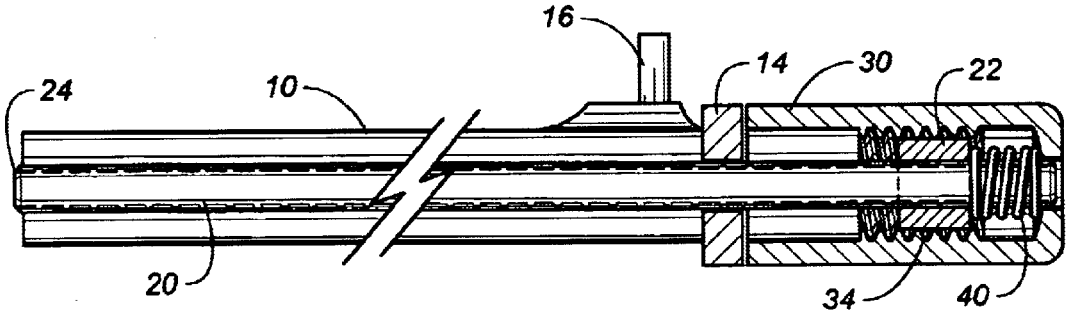
FIG. 4 is a sectional view of the barrel of the sport rifle combined with the removable inner barrel.
Figure 5:
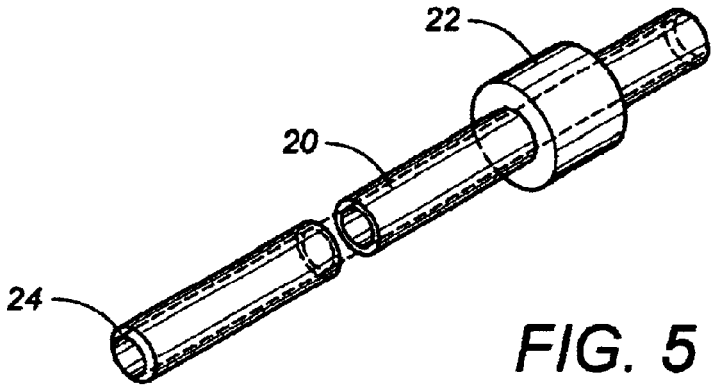
FIG. 5 is a perspective view of the removable inner barrel.
Figure 6:
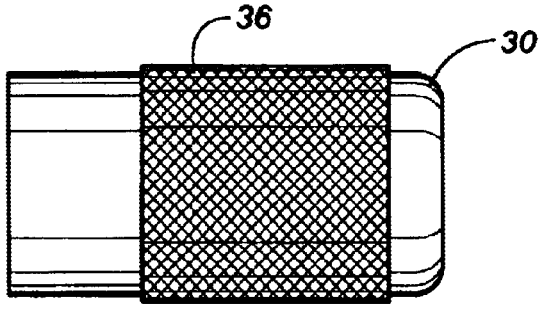
FIG. 6 is a front view of the pressure nut.
Figure 7:
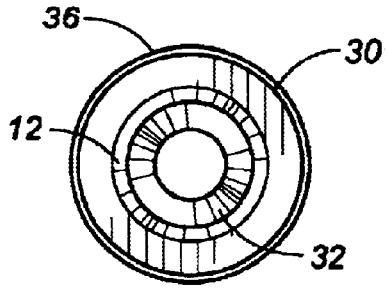
FIG. 7 is another left side view of the union nut.
Figure 8:
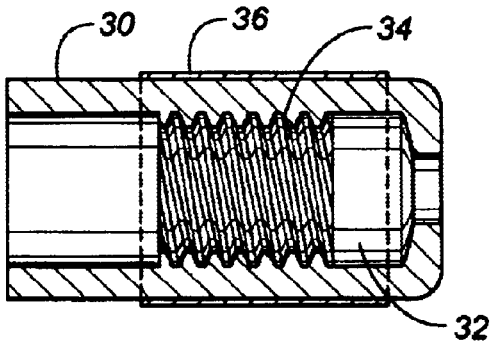
FIG. 8 is a sectional view of the pressure nut.
Figure 9:
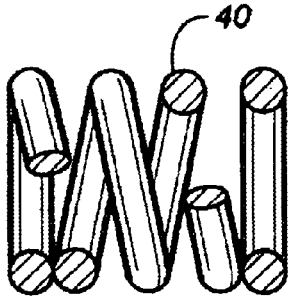
FIG. 9 is a sectional view of the compression spring.

The present invention, refers to a removable inner barrel for ammunition or pellets for sport rifles, by means of which a safe rifle operation is guaranteed, free from causing any accident and useful to be used with different calibers of ammunition by means of a simple change of the removable inner barrel.

In reference to the mentioned figures, the present invention, consists of a sport rifle with a butt as support for the shooting with a caisson of the mechanism precisely where the parts of a shooting mechanism of the weapon are located and by a barrel, an original barrel 10 of the rifle, in the front part, where the shooting or shot of the ammunition will exit.

This original barrel 10 of the rifle, comprehends in its frontal end, towards the exit where the shot will come out, an external thread 12, as a fixing element, followed by a top ring 14, located before the sight point 16, of the weapon, consisting in an annular string or fixed jacket, whose purpose is to serve as top for the closing up, meanwhile the interior part of the original barrel 10 of the rifle, is prepared for the polished wall and without special grooving.

A removable inner barrel 20, located by a tube with a diameter correlative to the interior diameter of the original barrel 10 of the rifle, inside it is hollow and grooved, where the interior diameter is correlative to the ammunition or pellet caliber. This removable inner barrel 20, presents in its superior extremity a bushing 22, united to the same body of the removable barrel 20, with the same diameter of the external diameter of the original barrel 10 of the rifle, so when the removable inner barrel is introduced inside this it will stop, coming out from the extremity part of such inner barrel 20, a part or section lightly short which is called projecting terminal 24, at the extremity where the ammunition or pellet is introduced. A pressure nut 30 is formed of a cylindrical piece, with grooves (knurled) 36, by its exterior face whose function will be to serve as a supporting element, and its drilled interior, carrying on one end an orifice 32 bigger in diameter compared to the exterior diameter of the barrel 10, for its introduction in it, besides an interior thread 34, correlative to the thread 12, with which the pressure nut 30 will stay fixed until the moment of arriving to the top 14.

A compression spring 40, which stays at the end of the orifice 32, whose function is to serve as a damping element and at the same time, to ensure an appropriate airtightness between the interior barrel 20 and the weapon mechanism, the spring left pressed 40 against the frontal wall of the bushing 22, and at the same time such a push is transmitted up to the end of the inner barrel 10, causing the end of the projecting terminal just out slightly 24, which is the place where the ammunition or pellet will be introduced, exactly in front of where the caisson of the weapon mechanism is located and an air expansion will be produced with the characteristic that by means of this spring, compressed air leakage is avoided.

On the other hand, orifice 32, is coincident with the bushing diameter 22, and remains transversally grasped together with the removable inner barrel 20 but with a longitudinal movement derived from the spring damping effort 40, whose stroke or play, corresponds to the length that projects at the end of the projecting terminal 24 of the removable inner barrel 20.

Finally, the orifice 32, diminishes its diameter up to the correlative exterior diameter of the removable inner barrel 20, to stick out the end of that by the pressure nut 30.

Each rifle will come with several inner tubes 20 properly identified by the caliber of the ammunition in order to avoid mistakes.

Inasmuch as the way to operate all the mechanism mentioned before, it is very simple, because it will be sufficient to insert in the original barrel 10 of the sport rifle the inner barrel 20, placing the spring 40, in the inner nut 30, in order to fasten and tighten the nut 30 by means of the external cord 12, taking this nut 30 until this makes contact with the top ring 14.

Doing this, the spring 40, will stay loose, pushing the frontal face of the bushing 22, and so the projecting ending 24 of the removable inner barrel 20 presents itself slightly projecting in front of the caisson of the weapon mechanism.

During the breaking of the rifle to load the ammunition or pellet, the terminal 24 will be projecting. An ammunition or pellet is placed, and when closing the rifle, the plate of the caisson of the mechanism, compresses the projecting terminal 24 so, then, the face of the bushing 22, compresses the spring 40 up to its maximum position, projecting the end of the inner barrel 20, by the minor orifice of the nut 30. This operation of the longitudinal movement of the inner barrel 20, repeats itself in the opposite way when breaking the rifle to be loaded.

Thus, for example, if it is desired to operate the rifle with higher speed exit of the ammunition or pellet, an inner barrel will be used 20 with a minor inner diameter and so the impact force will be minor, if on the contrary a major impact force is desired, an inner barrel is placed 20 with an inner major diameter, and so the exit speed of the projectile diminishes.

In this way, in order to use different calibers of ammunition and pellets, the only thing required is to change the different types of inner barrels 20, using the same rifle.

I claim:

1. A removable inner barrel apparatus comprising:

a rifle having a barrel extending therefrom, said barrel having a sight point at a top thereof, said barrel having a polished inner wall without striping, said barrel having an external thread at an end thereof and a top ring positioned between said external thread and said sight point, said top ring positioned adjacent said sight point, said top ring being an annular ring or a fixed jacket;

an inner barrel having an end through which ammunition can exit said inner barrel being a tube having an outer diameter corresponding to an inner diameter of said barrel of said rifle, said inner barrel having a grooved hollow interior, said interior of said inner barrel having a diameter corresponding to a diameter of the ammunition, said inner barrel having a bushing affixed adjacent an opposite end of said inner barrel, said bushing having an outer diameter that is the same as an external diameter of said barrel of said rifle, said bushing having a surface abutting said end of said barrel of said rifle when said inner barrel is introduced within said barrel of said rifle, said inner barrel having said end extending outwardly of an opposite end of said barrel of said rifle where the ammunition is introduced;

a pressure nut removably fastening said barrel of said rifle to said inner barrel, said pressure nut formed of an cylindrical piece having grooves formed on an exterior face thereof, said pressure nut having a drilled interior, said pressure nut having an orifice at one end that has a diameter greater than said external diameter of said barrel of said rifle, said pressure nut having a thread on said drilled interior, said thread engaging said external thread of said barrel so as to retain said inner barrel within said barrel of said rifle; and a compression spring positioned within said pressure nut adjacent said orifice thereof, said compression spring urging against an opposite surface of said bushing so as to to urge said surface of said bushing against said end of said inner barrel.

* * * * *